US007231899B2

(12) United States Patent
Wakamori et al.

(10) Patent No.: US 7,231,899 B2
(45) Date of Patent: Jun. 19, 2007

(54) MULTICYLINDER ENGINE INTAKE SYSTEM

(75) Inventors: Seiji Wakamori, Miyagi (JP); Kuniaki Takahashi, Miyagi (JP)

(73) Assignee: Keihin Corporation, Tokyo (JP)

( * ) Notice: Subject to any disclaimer, the term of this patent is extended or adjusted under 35 U.S.C. 154(b) by 0 days.

(21) Appl. No.: 11/410,309

(22) Filed: Apr. 25, 2006

(65) Prior Publication Data

US 2006/0254561 A1 Nov. 16, 2006

(30) Foreign Application Priority Data

Apr. 28, 2005 (JP) ..... 2005-130786

(51) Int. Cl.
*F02M 35/10* (2006.01)
*F02D 9/10* (2006.01)
*F02D 41/00* (2006.01)

(52) U.S. Cl. ..... 123/184.21; 123/336; 123/339.23

(58) Field of Classification Search ..... 123/184.21, 123/336, 339.23
See application file for complete search history.

(56) References Cited

U.S. PATENT DOCUMENTS 6,202,626 B1 * 3/2001 Ito et al. ..... 123/336
2002/0029759 A1 3/2002 Akagi et al.
2005/0022780 A1 2/2005 Imai et al.

FOREIGN PATENT DOCUMENTS

EP 0 905 366 A2 3/1999
JP 2003-129924 5/2003

* cited by examiner

*Primary Examiner*—Noah P. Kamen
(74) *Attorney, Agent, or Firm*—Arent Fox LLP

(57) ABSTRACT

A multicylinder engine intake system includes: a plurality of intake paths; a plurality of bypasses detouring throttle valves and connected to the intake paths; and a common bypass control valve for opening and closing the bypasses. The bypass control valve is constituted by a valve body and an electrically operated actuator provided above the valve body and operated for opening and closing the valve body. A portion of a bypass upstream path in the bypasses on upstream side of the valve body is placed below the valve body. Idling air paths branch off from the portion of the bypass upstream path to reach the corresponding intake paths. Thus, it is possible to prevent fuel or dater droplets from staying in the bypasses and appropriately control the amount of first idling air by the bypass control valve.

4 Claims, 11 Drawing Sheets

MULTICYLINDER ENGINE INTAKE SYSTEM

RELATED APPLICATION DATA

The present invention is based upon Japanese priority application No. 2005-130786, which is hereby incorporated in its entirety herein by reference.

BACKGROUND OF THE INVENTION

1. Field of the Invention

The present invention relates to an improvement in a multicylinder engine intake system comprising: a plurality of intake paths communicating with intake ports of a multicylinder engine; a plurality of throttle valves for opening and closing the intake paths; a plurality of bypasses having upstream ends opened to atmosphere or the intake paths on upstream sides of the throttle valves, and having downstream ends opened to the intake paths on downstream sides of the throttle valves; and a common bypass control valve which opens and closes the bypasses.

2. Description of the Related Art

A bypass control valve in a multicylinder engine intake system is operated to regulate the amount of first idling air supplied to the engine through bypasses in order to appropriately control a first idling rotational speed mainly during engine warm-up operation.

A multicylinder engine intake system of this type is known from, e.g., Japanese Patent Application Laid-open No. 2003-129924.

In the multicylinder engine intake system disclosed in Japanese Patent Application Laid-open No. 2003-129924, the bypass control valve is horizontally placed, leading to a possibility that fuel or water droplets entering the bypasses stays around the bypass control valve, and thus there is a need to provide an expensive sealing means for the bypass control valve. There is also a possibility that the fuel or water droplets staying around the bypass control valve hinders appropriate control of the amount of first idling air by the bypass control valve.

SUMMARY OF THE INVENTION

The present invention has been achieved in view of the above-mentioned circumstances, and has an object to provide a multicylinder engine intake system which is capable of preventing fuel or water droplets from staying in bypasses, in which no expensive sealing means for the bypass valve is required or a simple and inexpensive sealing means suffices, and which enables appropriate control of the amount of first idling air by the bypass control valve.

In order to achieve the above object, according to a first feature of the present invention, there is provided a multicylinder engine intake system having comprising: a plurality of intake paths communicating with intake ports of a multicylinder engine; a plurality of throttle valves for opening and closing the intake paths; a plurality of bypasses having upstream ends opened to atmosphere or the intake paths on upstream sides of the throttle valves, and having downstream ends opened to the intake paths on downstream sides of the throttle valves; and a common bypass control valve which opens and closes the bypasses, wherein the bypass control valve is constituted by a valve body for opening the plurality of bypasses, and an electrically operated actuator provided above the valve body and operated for opening and closing the valve body; a portion of a bypass upstream path in the bypasses on upstream side of the valve body is placed below the valve body; and idling air paths branch off from the portion of the bypass upstream path to reach the corresponding intake paths.

With the first feature of the present invention, the bypass control valve is constituted by the valve body for opening the plurality of bypasses, and the electrically operated actuator provided above the valve body and operated for opening and closing the valve body. This simple arrangement ensures that fuel or water droplets generated in the bypasses or entering the bypasses is prevented from flowing into the electrically operated actuator. Therefore no expensive sealing means is required for the electrically operated actuator, and only an inexpensive sealing means suffices.

The bypass upstream side path on the upstream side of the valve has a portion placed below the valve body and the idling air paths branch off from the portion of the bypass upstream side path to reach the corresponding intake paths. Therefore, fuel or water droplets generated in the bypasses or entering the bypasses flows down to the bypass upstream path, and the fuel or water droplets can be discharged to the intake paths by being carried on air flows which are flowing from the idling air paths to the downstream sides of the intake paths and which are always formed in the bypass upstream path irrespective of the opening/closing state of the valve body. Thus, staying of the fuel or water droplets in the bypasses is prevented to ensure that the amount of first idling air can be appropriately regulated by the bypass valve.

According to a second feature of the present invention, in addition to the first feature, the bypass upstream path is formed as a single path common to the plurality of bypasses.

With the second feature of the present invention, the bypass upstream path is formed as a single path common to the plurality of bypasses. This arrangement contributes to simplification of the structure of the bypass control valve as well as to simplification of the bypasses.

According to a third feature of the present invention, in addition to the first or second feature, a plurality of bypass downstream paths, on downstream side of the bypass control valve, of the plurality of bypasses are formed into a labyrinth shape.

With the third feature of the present invention, the plurality of bypass downstream paths of the bypasses on the downstream side of the bypass control valve are formed into a labyrinth shape, thereby attenuating gas blowback from the intake paths and preventing fuel and other unnecessary substances from entering the bypass control valve.

The above-mentioned object, other objects, characteristics, and advantages of the present invention will become apparent from a preferred embodiment which will be described in detail below by reference to the attached drawings.

DESCRIPTION OF THE PREFERRED EMBODIMENT

Figure 1:
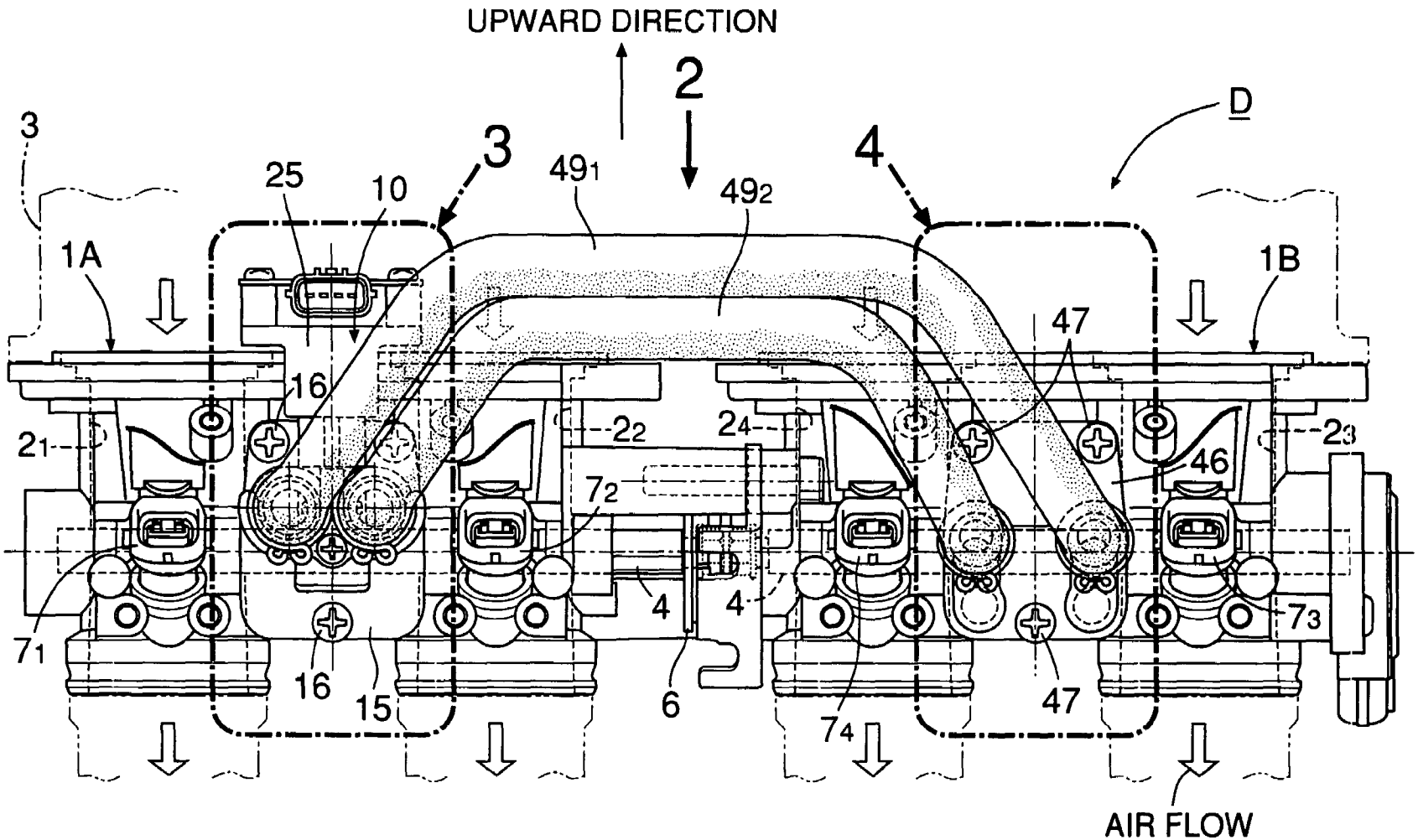
FIG. 1 is a front view of a multicylinder engine intake system according to the present invention.
Figure 2:
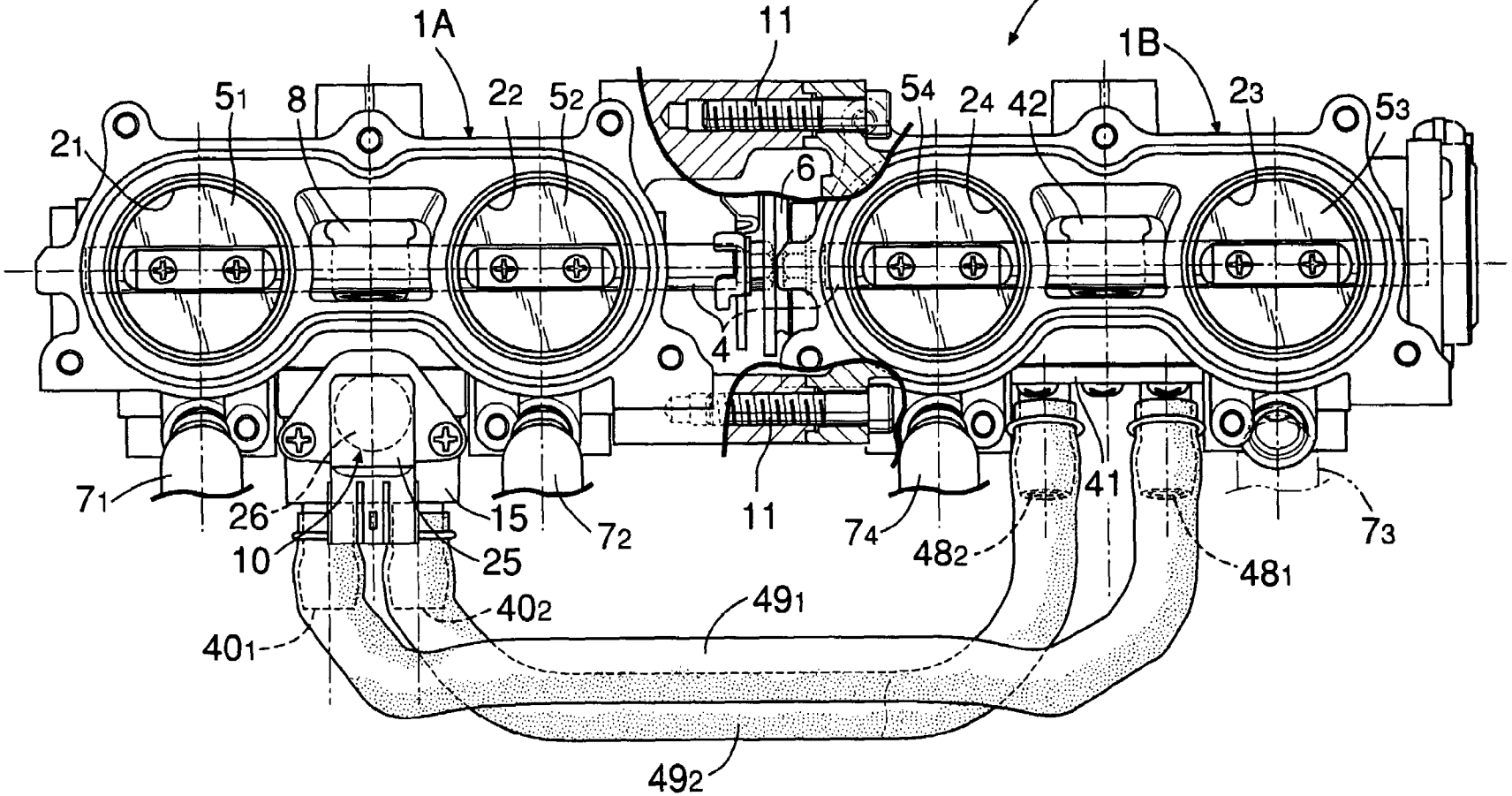
FIG. 2 a plan view as seen in the direction of arrow 2 in FIG. 1.
Figure 3:
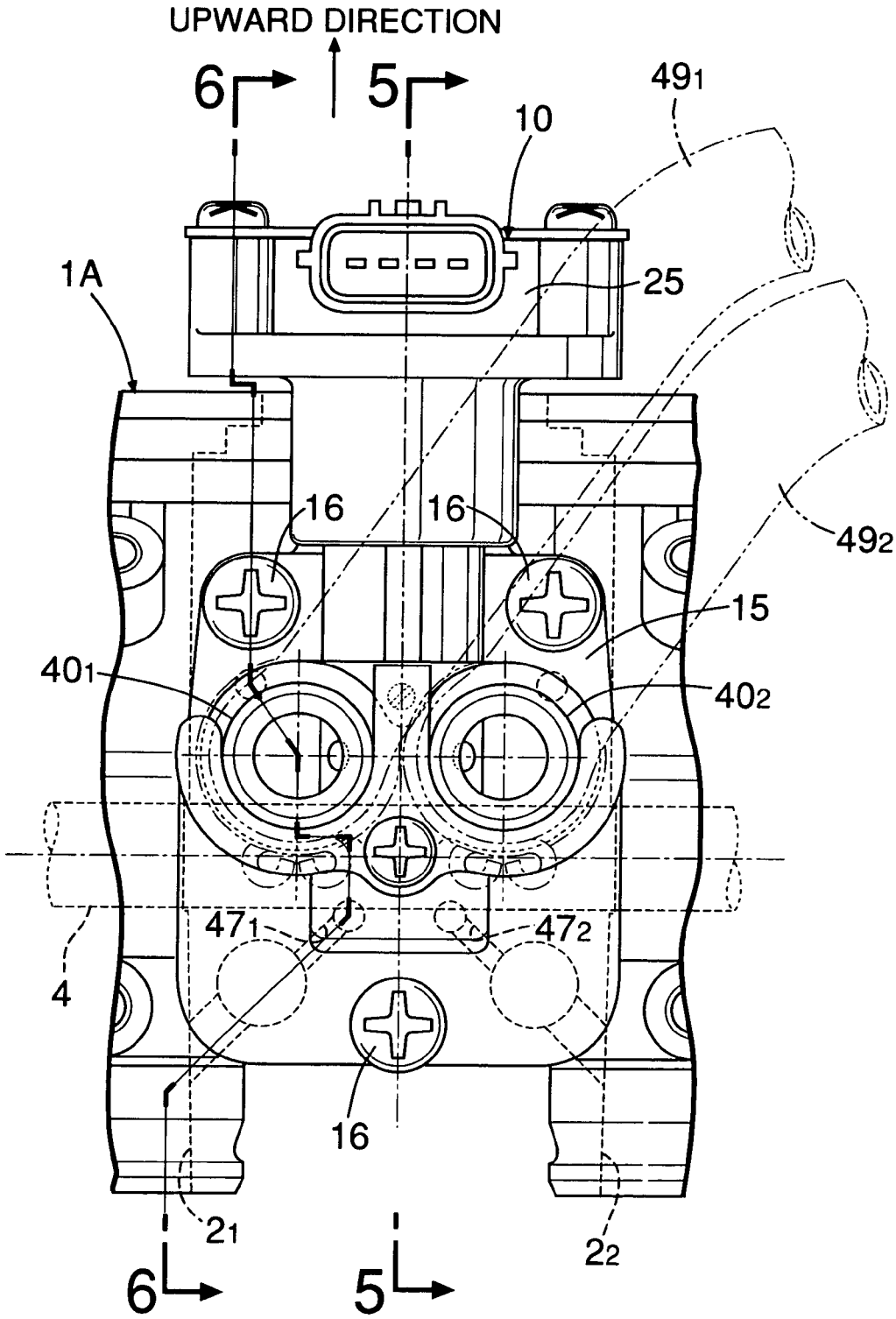
FIG. 3 is an enlarged view of portion 3 in FIG. 1.
Figure 11:
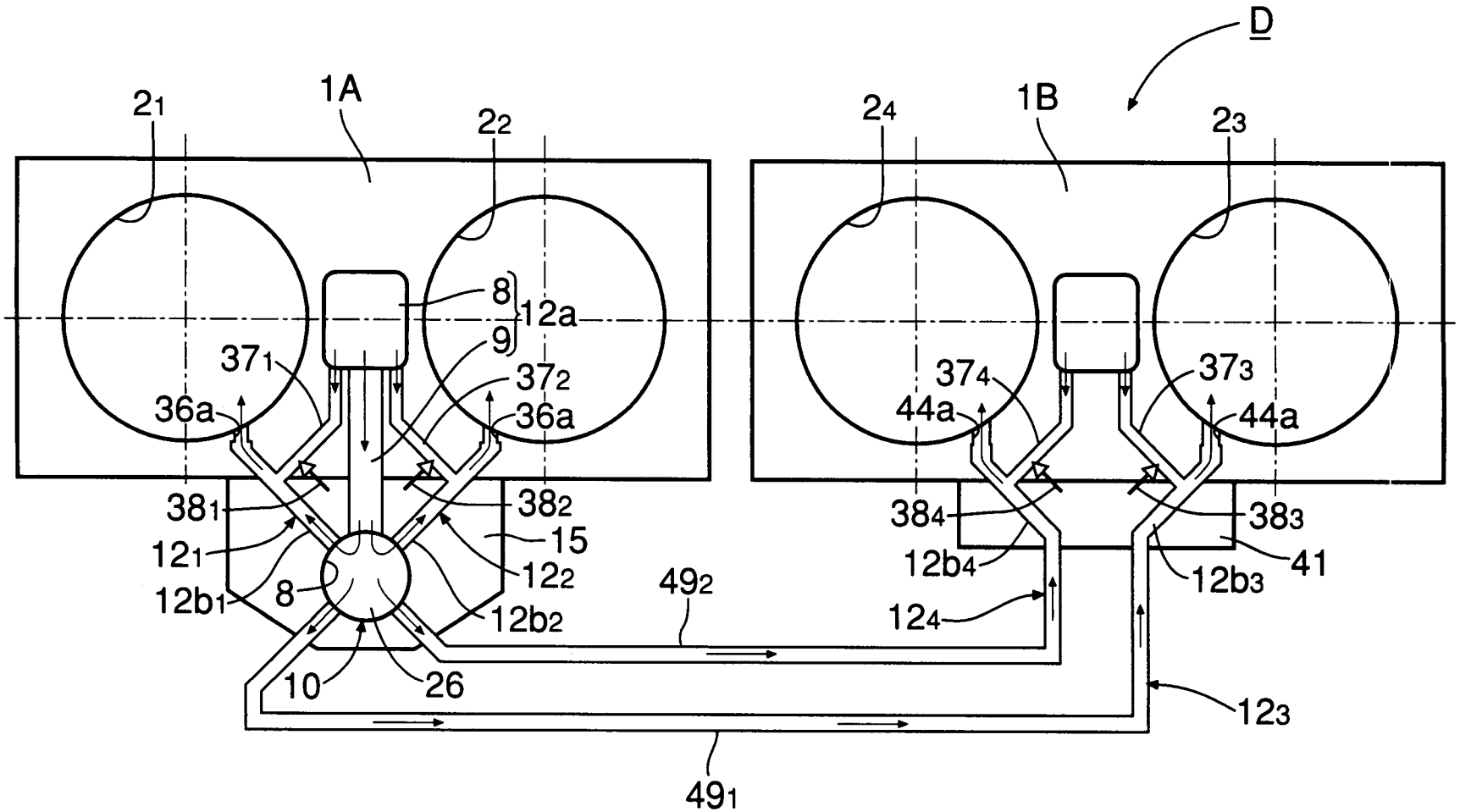
FIG. 11 is a diagram showing the entire air path scheme of the intake system.

Referring to FIGS. 1, 2 and 11, reference character D denotes an intake system for a four-cylinder engine. The intake system D has first and second throttle bodies 1A and 1B disposed in parallel with each other, and is constructed to be a downdraft type wherein pairs of intake paths $\mathbf{2}_1$, $\mathbf{2}_2$; $\mathbf{2}_3$, $\mathbf{2}_4$ parallel to each other are provided in the throttle bodies 1A and 1B, respectively, with their downstream ends downwardly leading to an engine (not shown). An air cleaner 3 in which upstream ends of the intake paths $\mathbf{2}_1$, $\mathbf{2}_2$; $\mathbf{2}_3$, $\mathbf{2}_4$ are opened is attached to upper end portions of the two throttle bodies 1A and 1B. The two throttle bodies 1A and 1B are connected integrally with each other by connecting bolts 11. The pairs of intake paths $\mathbf{2}_1$, $\mathbf{2}_2$; $\mathbf{2}_3$, $\mathbf{2}_4$ are each disposed symmetrically with each other.

As shown in FIGS. 1 to 6, valve shafts 4 which extend across the intake paths $\mathbf{2}_1$, $\mathbf{2}_2$; $\mathbf{2}_3$, $\mathbf{2}_4$ respectively are rotatably supported by the two throttle bodies 1A and 1B, and throttle valves $\mathbf{5}_1$, $\mathbf{5}_2$; $\mathbf{5}_3$, $\mathbf{5}_4$ for respectively opening/closing the intake paths $\mathbf{2}_1$, $\mathbf{2}_2$; $\mathbf{2}_3$, $\mathbf{2}_4$ are attached to the valve shafts 4. The two valve shafts 4 are disposed coaxially with each other, and have their opposed ends connected to each other by a throttle drum 6. The throttle valves $\mathbf{5}_1$, $\mathbf{5}_2$; $\mathbf{5}_3$, $\mathbf{5}_4$ are simultaneously opened or closed by rotating the throttle drum 6. Fuel injection valves $\mathbf{7}_1$, $\mathbf{7}_2$; $\mathbf{7}_3$, $\mathbf{7}_4$ for injecting fuel into intake ports of the engine through the intake paths $\mathbf{2}_1$, $\mathbf{2}_2$; $\mathbf{2}_3$, $\mathbf{2}_4$ downstream of the throttle valves $\mathbf{5}_1$, $\mathbf{5}_2$; $\mathbf{5}_3$, $\mathbf{5}_4$ are attached to the throttle bodies 1A and 1B.

As shown in FIGS. 3, 5, 6, and 11, an air inlet chamber 8 is formed in the first throttle body 1A between the pair of intake paths $\mathbf{2}_1$ and $\mathbf{2}_2$ so as to be opened in an upper end surface of the first throttle body 1A on the air cleaner 3 side, and a guide path 9 extending from the air inlet chamber 8 is also formed in the first throttle body 1A. A bypass control valve 10 is connected to the guide path 9. The air inlet chamber 8 and the guide path 9 constitute a bypass upstream path 12*a*.

Two pairs of bypass downstream paths $\mathbf{12}b_1$, $\mathbf{12}b_2$; $\mathbf{12}b_3$, $\mathbf{12}b_4$ extend from the bypass control valve 10. One pair of bypass downstream paths $\mathbf{12}b_3$ and $\mathbf{12}b_4$ are opened in the intake paths $\mathbf{2}_1$ and $\mathbf{2}_2$, respectively, in the first throttle body 1A downstream of the respective throttle valves $\mathbf{5}_1$ and $\mathbf{5}_2$. The other pair of bypass downstream paths $\mathbf{12}b_3$ and $\mathbf{12}b_4$ are opened in the intake paths $\mathbf{2}_3$ and $\mathbf{2}_4$, respectively, in the second throttle body 1B downstream of the respective throttle valves $\mathbf{5}_3$ and $\mathbf{5}_4$.

Thus, as clearly shown in FIG. 11, the bypass upstream path 12*a* and the bypass downstream paths $\mathbf{12}b_1$, $\mathbf{12}b_2$; $\mathbf{12}b_3$, $\mathbf{12}b_4$ constitute bypasses $\mathbf{12}_1$, $\mathbf{12}_2$; $\mathbf{12}_3$, $\mathbf{12}_4$ connected to the intake paths $\mathbf{2}_1$, $\mathbf{2}_2$; $\mathbf{2}_3$, $\mathbf{2}_4$, respectively, while detouring around the respective throttle valves $\mathbf{5}_1$, $\mathbf{5}_2$; $\mathbf{5}_3$, $\mathbf{5}_4$. The bypass upstream path 12*a* is a single path common to all the bypasses $\mathbf{12}_1$, $\mathbf{12}_2$; $\mathbf{12}_3$, $\mathbf{12}_4$. The bypass control valve 10 has functions of distributing secondary air introduced into single bypass upstream path to the intake paths $\mathbf{2}_1$, $\mathbf{2}_2$; $\mathbf{2}_3$, $\mathbf{2}_4$ through the bypass downstream paths $\mathbf{12}b_1$, $\mathbf{12}b_2$; $\mathbf{12}b_3$, $\mathbf{12}b_4$, respectively, and simultaneously controlling the amount of air distribution.

The structures of the bypasses $\mathbf{12}_1$ and $\mathbf{12}_2$ on the first throttle body 1A side and the bypass control valve 10 will be specifically described with reference to FIGS. 3, 5 and 6 to 9.

A control block 15 is detachably joined to one side surface of the first throttle body 1A by a plurality of bolts 16, with a gasket 17 interposed therebetween. A cylindrical valve chamber 18 extending in a vertical direction is provided in the control block 15, and the above-described guide path 9 through which a lower portion of the air inlet chamber 8 communicates with a lower portion of the valve chamber 18 is provided between the first throttle body 1A and the control block 15. Thus, the bypass upstream path 12*a* is placed below a valve body 26.

Two pairs of distribution chambers $\mathbf{32}_1$, $\mathbf{32}_2$; $\mathbf{32}_3$, $\mathbf{32}_4$ are provided around a lower portion of the valve chamber 18. Two pairs of measuring holes $\mathbf{19}_1$, $\mathbf{19}_2$; $\mathbf{19}_3$, $\mathbf{19}_4$ that provide communication between the valve chamber 18 and the distribution chambers $\mathbf{32}_1$, $\mathbf{32}_2$; $\mathbf{32}_3$, $\mathbf{32}_4$ are bored in a peripheral wall of the valve chamber 18.

The valve body 26 in the form of a piston for regulating the opening degree of the measuring holes $\mathbf{19}_1$, $\mathbf{19}_2$; $\mathbf{19}_3$, $\mathbf{19}_4$ between the fully closed state and the fully opened state is slidably fitted from above into the valve chamber 18. To prevent the valve body 26 from rotating, a key groove 27 and a key 28 engageable with the key groove 27 are provided. The key groove 27 is provided on a side surface of the valve body 26. The key 28 is attached to the control block 15. An electrically operated actuator 25 which causes the valve body 26 to open and close the valve opening is fitted in a fitting hole 29 formed in the control block 15 continuously with the upper end of the valve chamber 18, and is fixed to the control block 15 by bolts. The electrically operated actuator 25 has a downwardly projecting output shaft 30 screwed into a threaded hole 31 formed in a central portion of the valve body 26. The valve body 26 can be moved upward or downward (for opening or closing) by rotating the output shaft 30 in the normal or reverse direction. A plate-shaped sealing member 23 which is brought into intimate contact with an outer peripheral surface of the output shaft 30 is interposed between a lower surface of the electrically operated actuator 25 and a bottom surface of the fitting hole 29. The valve body 26 and the electrically operated actuator 25 thus constitute the bypass control valve 10.

In the control block 15, the above-described pair of distribution chambers $\mathbf{32}_1$ and $\mathbf{32}_2$ and a pair of second labyrinth elements 35 disposed below the distribution chambers $\mathbf{32}_1$ and $\mathbf{32}_2$ are formed so as to be open in a joint surface 15*a* (see FIG. 7) of the control block 15 joined with respect to the first throttle body 1A. Partition walls 33 are provided between the distribution chambers $\mathbf{32}_1$ and $\mathbf{32}_2$ and the second labyrinth elements 35. In the first throttle body 1A, a pair of first labyrinth elements 34 and a pair of communication holes 36 disposed below the first labyrinth elements 34 are formed so as to be open in a joint surface 1A*a* (see FIG. 8). When the control block 15 is joined to the first throttle body 1A, the first labyrinth elements 34 provide communication between the distribution chambers $\mathbf{32}_1$ and $\mathbf{32}_2$ and the second labyrinth elements 35, and the communication holes 36 communicate with the second labyrinth elements 35. Each of the communication holes 36 is formed by providing a plurality of drilled holes in alignment with each other. Terminal ends of the communication holes 36 are open in the intake paths 21 and 22 downstream of the throttle valves 51 and 52.

Thus, the measuring holes $\mathbf{19}_1$and $\mathbf{19}_2$, the distribution chambers $\mathbf{32}_1$, and $\mathbf{32}_2$, the first labyrinth elements 34, the second labyrinth elements 35 and the communication holes 36 constitute the bypass downstream paths $\mathbf{12}b_1$ and $\mathbf{12}b_2$, having a labyrinth shape, in the pair of bypasses $\mathbf{12}_1$ and $\mathbf{12}_2$ on the first throttle body 1A side.

Idling air paths $\mathbf{37}_1$ and $\mathbf{37}_2$ provide communication between a lower portion of the air inlet chamber 8 and each of intermediate portions of the communication holes 36. A pair of idling regulation screws $\mathbf{38}_1$ and $\mathbf{38}_2$ capable of regulating the path area in intermediate portions of the idling air paths $\mathbf{37}_1$ and $\mathbf{37}_2$ are threaded into the first throttle body 1A (see FIG. 11 as well).

A pair of joint pipes $\mathbf{40}_1$ and $\mathbf{40}_2$ which communicate with the other pair of distribution chambers $\mathbf{32}_3$ and $\mathbf{32}_4$ are attached to the control block 15.

Figure 4:
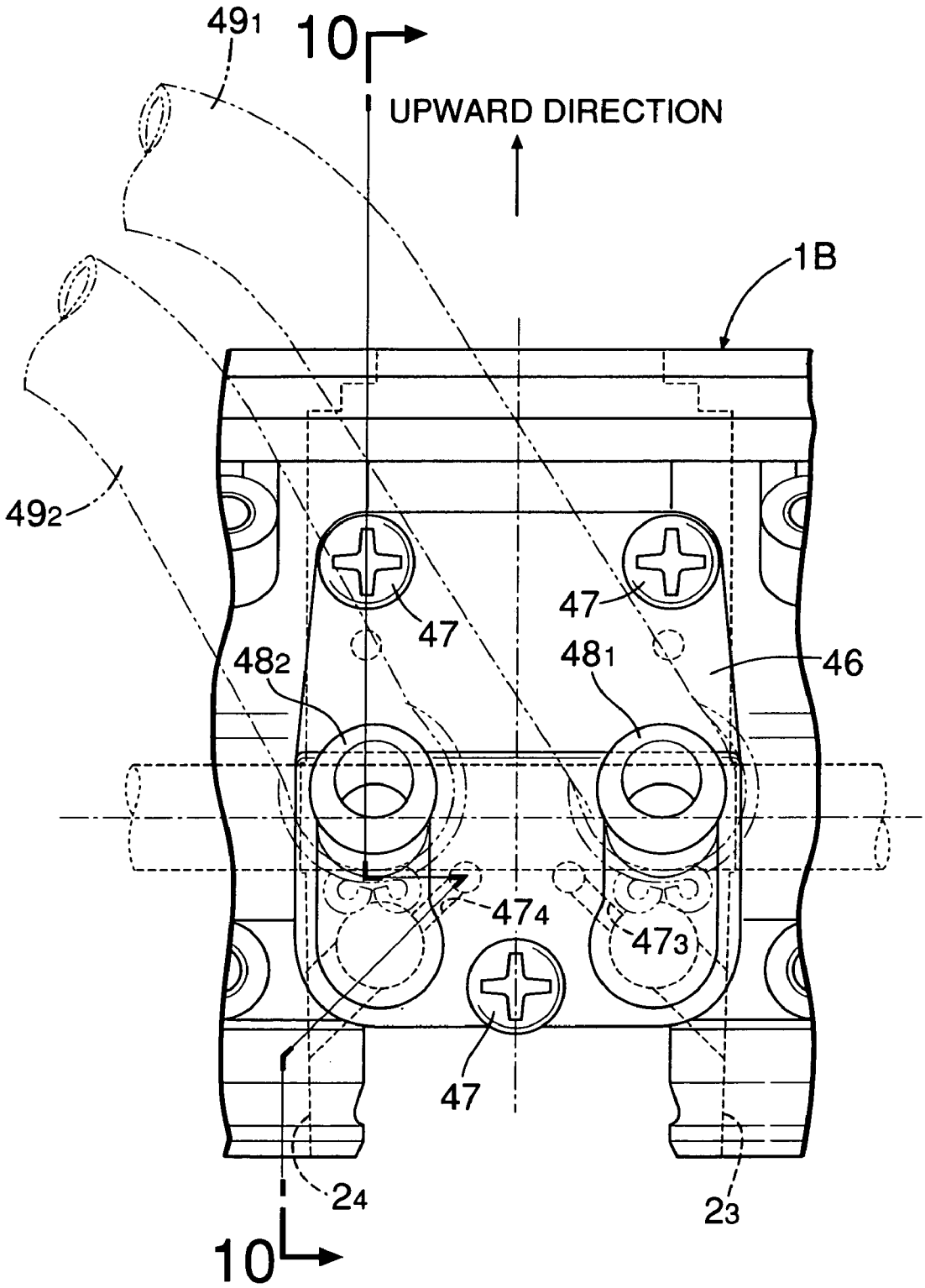
FIG. 4 is an enlarged view of portion 4 in FIG. 1.
Figure 5:
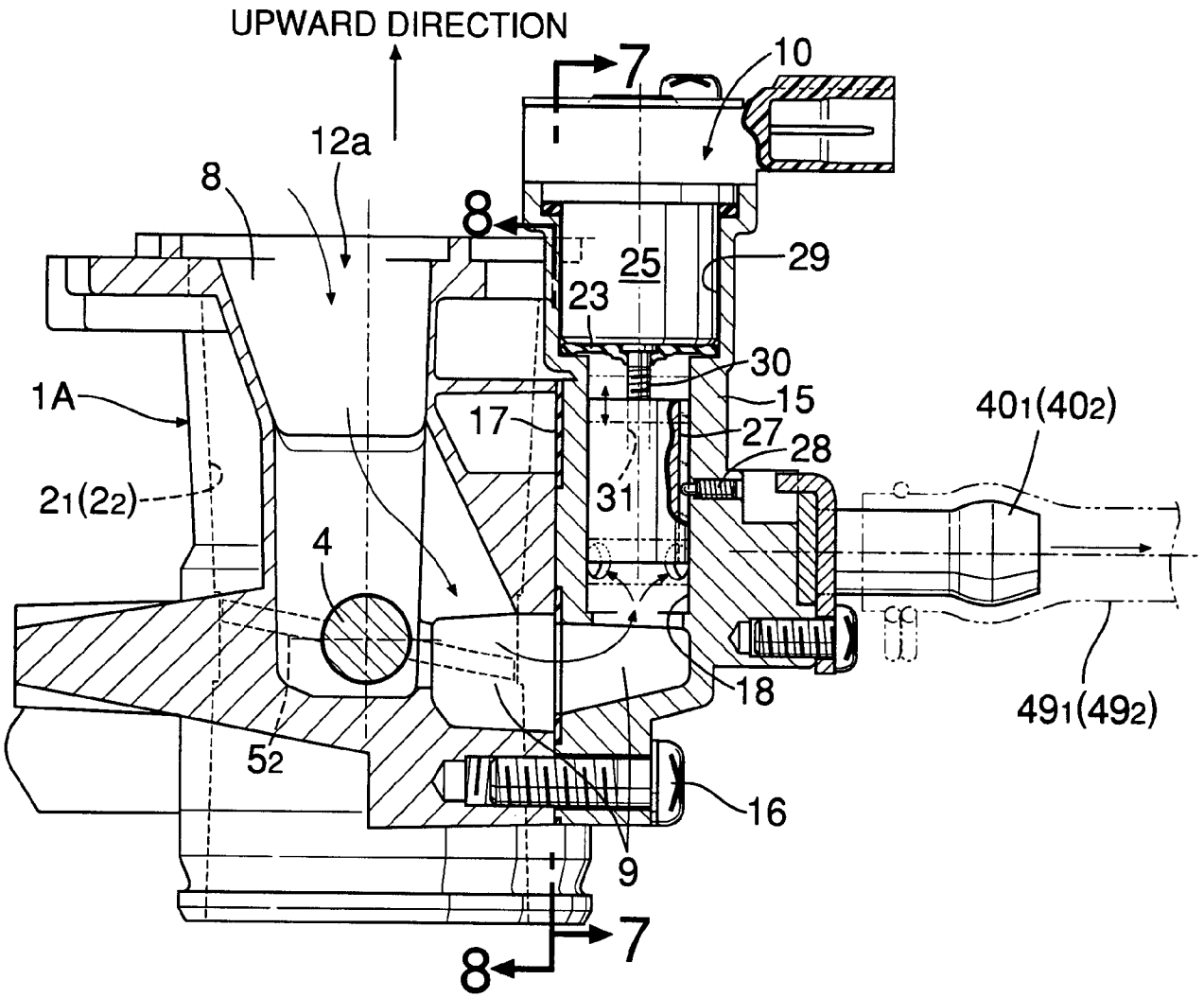
FIG. 5 is a sectional view taken along a line 5—5 in FIG. 3.

The structure of the bypasses $\mathbf{12}_3$ and $\mathbf{12}_4$ on the second throttle body 1B side will be specifically described with reference to FIGS. 1, 4 and 10.

Figure 10:
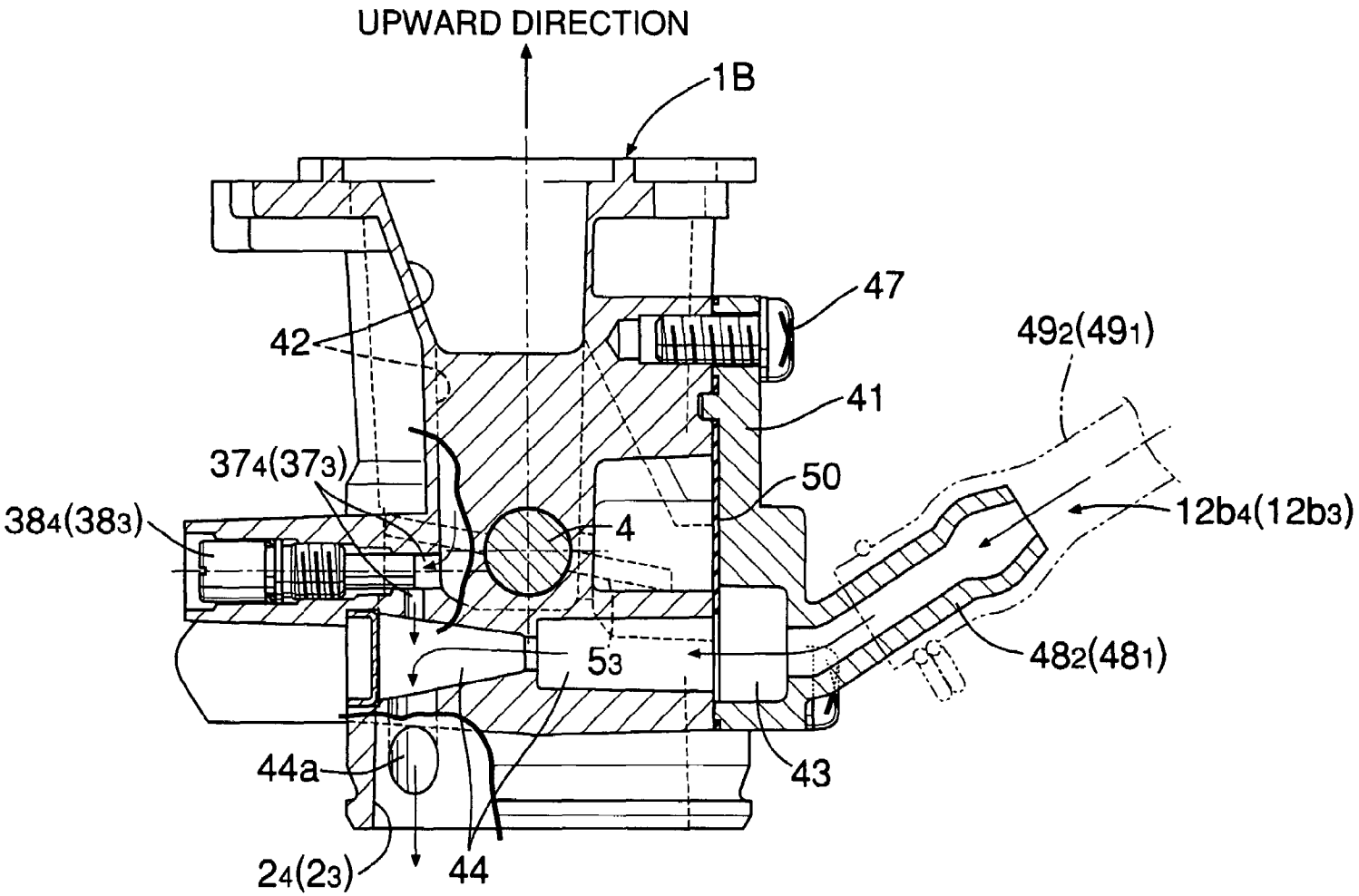
FIG. 10 is a sectional view taken along line 10—10 in FIG. 4.

Provided in the second throttle body 1B are one air inlet chamber 42 which is open on the air cleaner 3 side between the first and second intake paths $\mathbf{2}_3$ and $\mathbf{2}_4$, a pair of distribution chambers 43 (only one of which is shown in FIG. 10) which are open in one side surface of the second throttle body 1B below the air inlet chamber 42, a pair of communication holes 44 which extend from the distribution chambers 43 to the first and second intake paths $\mathbf{2}_3$ and $\mathbf{2}_4$ downstream of the throttle valves $\mathbf{5}_3$ and $\mathbf{5}_4$, and a pair of idling air paths $\mathbf{37}_3$ and $\mathbf{37}_4$ which provide communication between intermediate portions of the communication holes 44 and a lower portion of the air inlet chamber 42. A joint block 41 having a pair of joint pipes $\mathbf{48}_1$ and $\mathbf{48}_2$ communicating with the distribution chambers 43 is joined to the one side surface of the second throttle body 1B by bolts 47 with a gasket 50 interposed therebetween. The joint pipes $\mathbf{40}_1$ and $\mathbf{40}_2$ of the control block 15 and the joint pipes $\mathbf{48}_1$ and $\mathbf{48}_2$ of the joint block 41 are connected to each other by a pair of communication pipes $\mathbf{49}_1$ and $\mathbf{49}_2$.

Thus, the measuring holes $\mathbf{19}_3$ and $\mathbf{19}_4$, the distribution chambers $\mathbf{32}_3$ and $\mathbf{32}_4$, the communication pipes $\mathbf{49}_1$ and $\mathbf{49}_2$ and the communication holes 44 constitute the bypass downstream paths $\mathbf{12}b_3$ and $\mathbf{12}b_4$ in the pair of bypasses $\mathbf{12}_3$ and $\mathbf{12}_4$ on the second throttle body 1B side.

A pair of idling regulation screws $\mathbf{38}_3$ and $\mathbf{38}_4$ capable of regulating the path area in intermediate portions of the idling air paths $\mathbf{37}_3$ and $\mathbf{37}_4$ are threaded into the second throttle body 1B.

The idling air paths $\mathbf{37}_1$, $\mathbf{37}_2$; $\mathbf{37}_3$, $\mathbf{37}_4$ are respectively provided for the purpose of maintaining the amount of idling air necessary for ordinary idling of the engine when the bypasses $\mathbf{12}_1$, $\mathbf{12}_2$; $\mathbf{12}_3$, $\mathbf{12}_4$ are completely closed by the bypass control valve 10. The amount of idling air is regulated by means of the idling regulation screws $\mathbf{38}_1$ and $\mathbf{38}_2$; $\mathbf{38}_3$ and $\mathbf{38}_4$.

Figure 6:
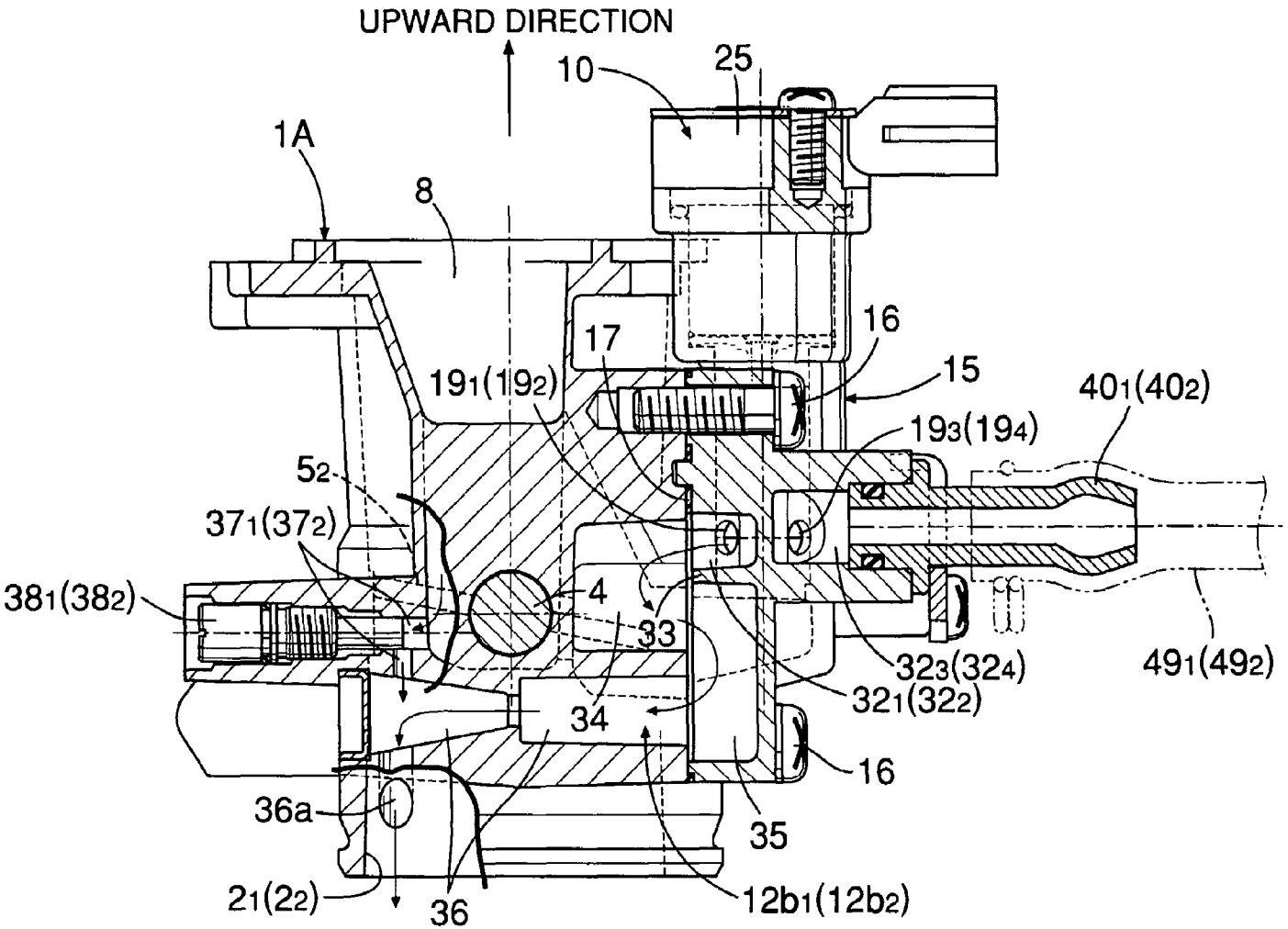
FIG. 6 is a sectional view taken along line 6—6 in FIG. 3.
Figure 7:
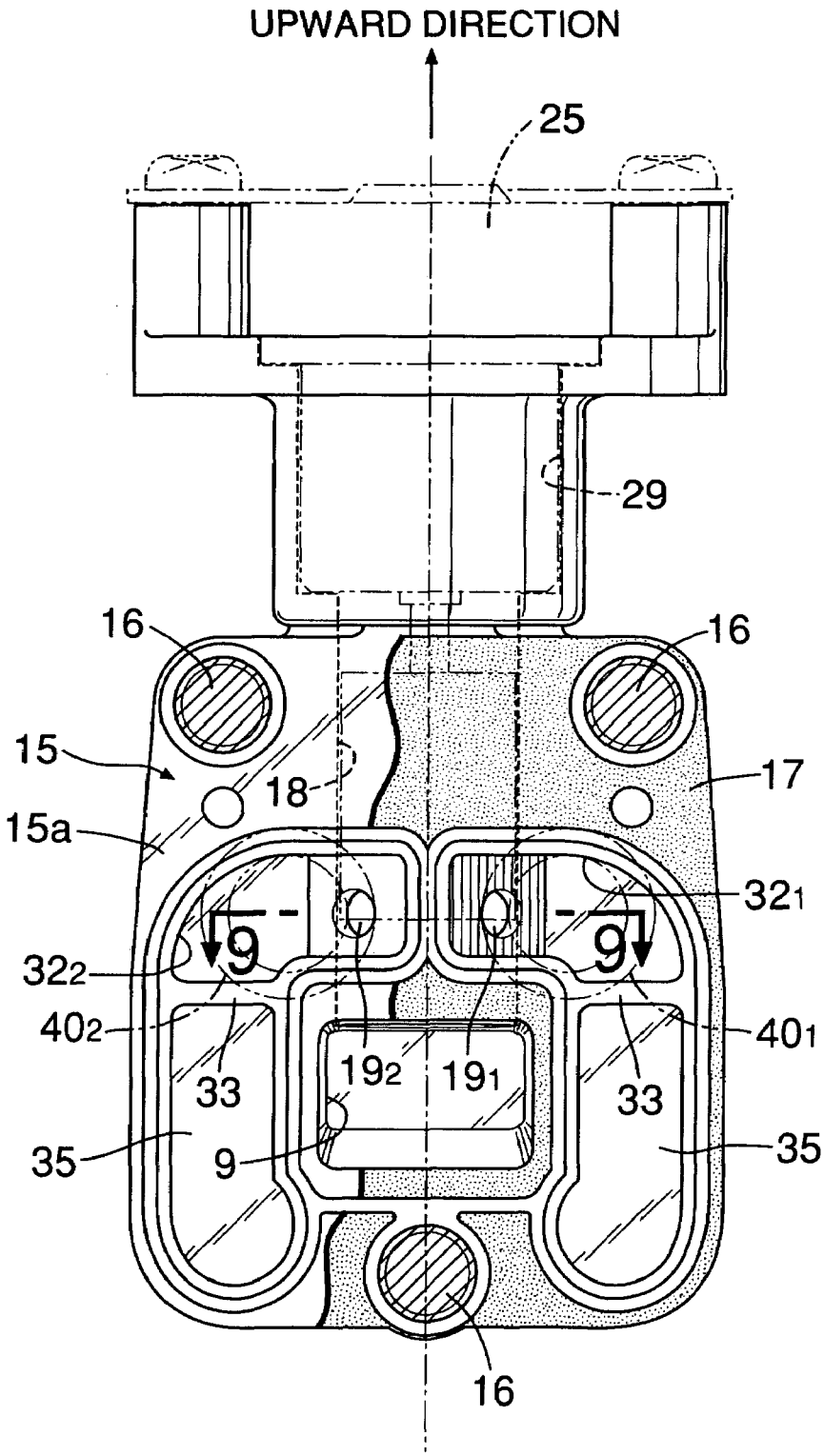
FIG. 7 is a sectional view taken along line 7—7 in FIG. 5.
Figure 8:
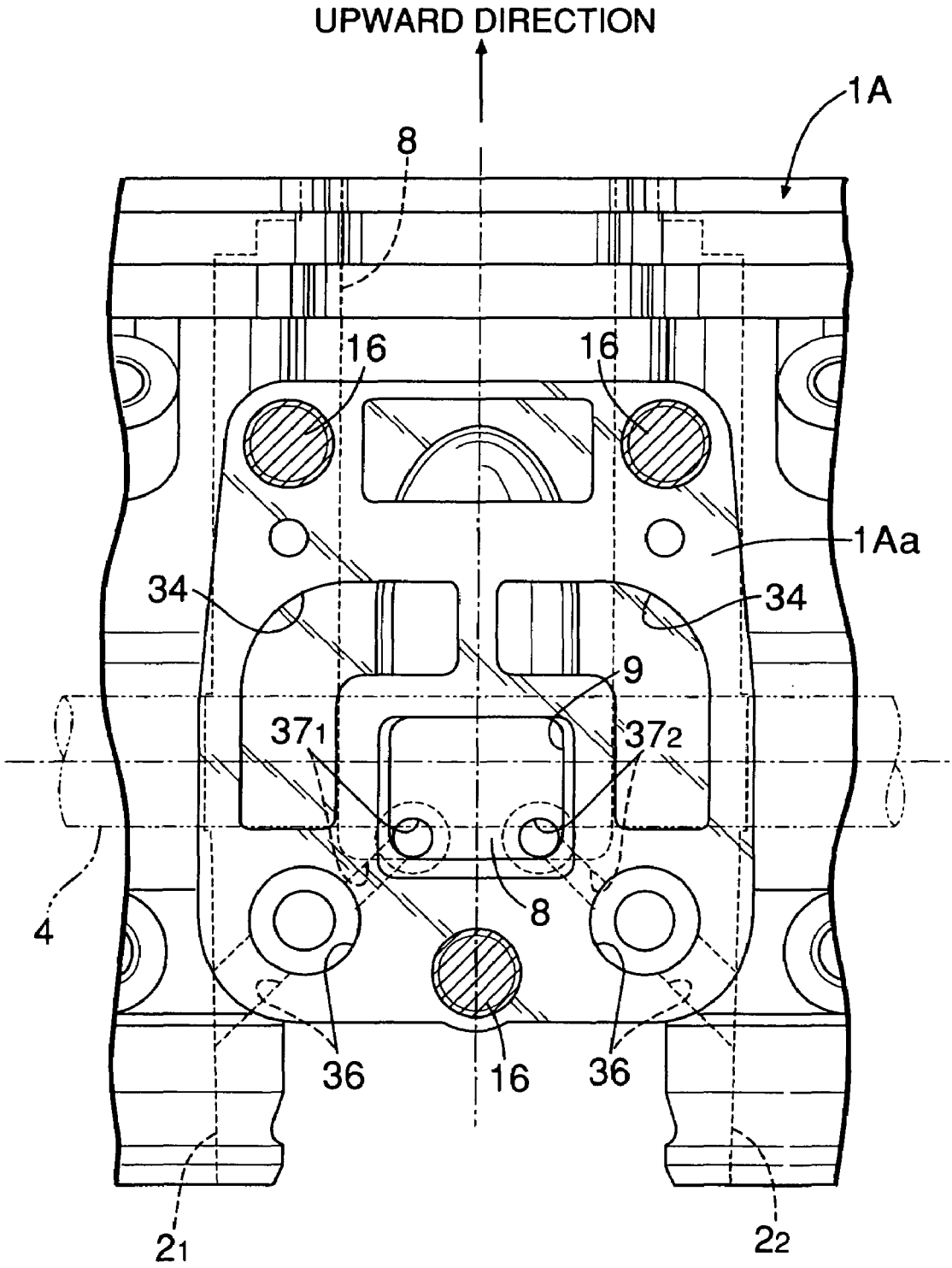
FIG. 8 is a sectional view taken along line 8—8 in FIG. 5.
Figure 9:
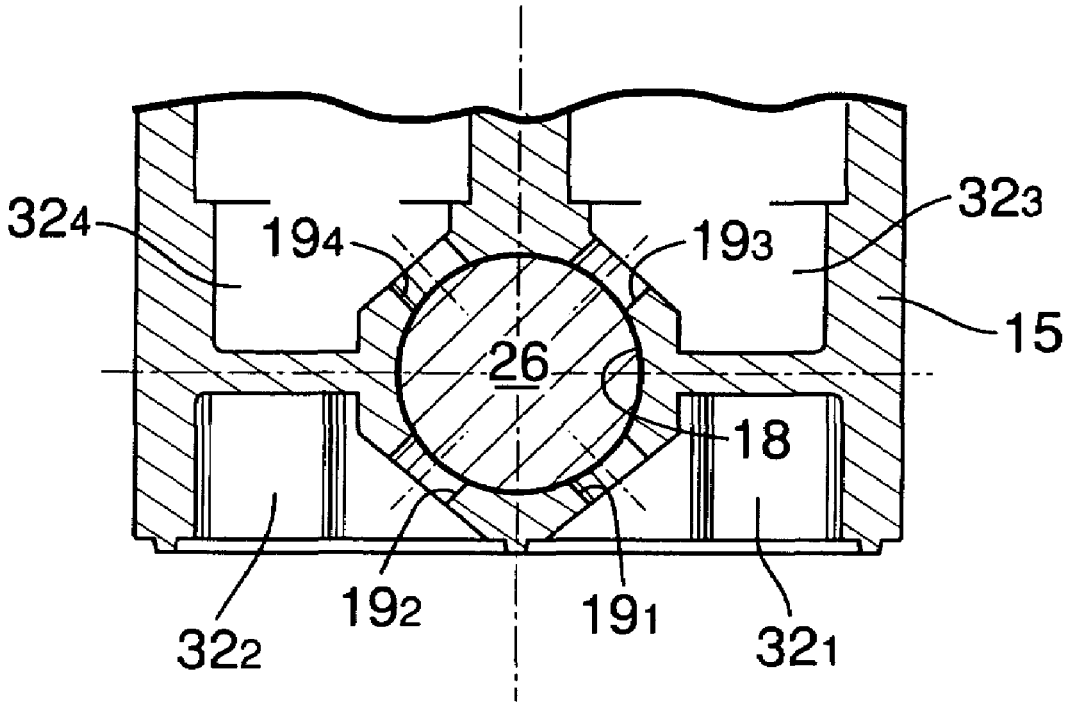
FIG. 9 is a sectional view taken along line 9—9 in FIG. 8.

As shown in FIGS. 6, 10 and 11, the downstream ends of the bypasses $\mathbf{12}_1$, $\mathbf{12}_2$; $\mathbf{12}_3$, $\mathbf{12}_4$ opened in downstream portions of the intake paths $\mathbf{2}_1$, $\mathbf{2}_2$; $\mathbf{2}_3$, $\mathbf{2}_4$ of the first and second throttle bodies 1A and 1B, i.e., the outlet opening degrees of the communication holes 36 and 44 are formed as throttle holes 36*a* and 44*a*, respectively. The throttle holes 44*a* on the second throttle body 1B side where the bypass control valve 10 is not provided are formed so as to be larger in diameter than the throttle holes 36*a* on the first throttle body 1A side where the bypass control valve 10 is provided. The difference between the diameters of the throttle holes 36*a* and 44*a* is determined by the difference between the lengths of the corresponding bypass downstream paths $\mathbf{12}b_1$, $\mathbf{12}b_2$; $\mathbf{12}b_3$, $\mathbf{12}b_4$. That is, on the first throttle body 1A side, the bypass control valve 10 supported on the first throttle body 1A is placed at equal and comparatively small distances from the pair of intake paths $\mathbf{2}_1$ and $\mathbf{2}_2$, so that the lengths of the bypass downstream paths $\mathbf{12}b_1$ and $\mathbf{12}b_2$ on the first throttle body 1A side are set to comparatively small and equal to each other. Accordingly, the throttle holes 36*a* of the bypass downstream paths $\mathbf{12}b_1$ and $\mathbf{12}b_2$ are formed so as to be comparatively small and equal in diameter. On the other hand, on the second throttle body 1B side where the throttle control valve 10 is not provided, the lengths of the bypass downstream paths $\mathbf{12}b_3$ and $\mathbf{12}b_4$ between the throttle control valve 10 and intake paths $\mathbf{2}_3$ and $\mathbf{2}_4$ are inevitably increased, and thus the throttle holes 44*a* of the bypass downstream paths $\mathbf{12}b_3$ and $\mathbf{12}b_4$ are formed so as to be comparatively large and equal in diameter.

The operation of this embodiment will next be described.

During engine warm-up operation, a controller (not shown) operates the electrically operated actuator 25 for the bypass control valve 10 by supplying the actuator 25 with a current corresponding to the engine temperature. When the engine temperature is low, the valve body 26 is lifted by a large amount to regulate the opening degrees of the measuring holes $\mathbf{19}_1$, $\mathbf{19}_2$; $\mathbf{19}_3$, $\mathbf{19}_4$ to be large. Therefore, in the state where the throttle valves $\mathbf{5}_1$, $\mathbf{5}_2$; $\mathbf{5}_3$, $\mathbf{5}_4$ are fully opened, the amount of first idling air supplied to the engine through the bypasses $\mathbf{12}_1$, $\mathbf{12}_2$; $\mathbf{12}_3$, $\mathbf{12}_4$ is controlled to be comparatively large by means of the measuring holes $\mathbf{19}_1$, $\mathbf{19}_2$; $\mathbf{19}_3$, $\mathbf{19}_4$. Simultaneously, the amount of fuel according to the amount of operation of the electrically operated actuator 25 are injected from the fuel injection valves $\mathbf{7}_1$, $\mathbf{7}_2$; $\mathbf{7}_3$, $\mathbf{7}_4$ toward the downstream sides of the intake paths $\mathbf{2}_1$, $\mathbf{2}_2$; $\mathbf{2}_3$, $\mathbf{2}_4$. The engine receives the thus-supplied air and fuel to maintain an appropriate first idling speed so that the warm-up operation progresses.

Since the bypass control valve 10 is attached to the first throttle body 1A side, the need for an attachment member exclusively for attachment of the bypass control valve 10 can be eliminated to simplify the structure of the intake system D. Also, the downstream ends of the bypasses $\mathbf{12}_1$, $\mathbf{12}_2$; $\mathbf{12}_3$, $\mathbf{12}_4$opened in downstream portions of the intake paths $\mathbf{2}_1$, $\mathbf{2}_2$; $\mathbf{2}_3$, $\mathbf{2}_4$ of the first and second throttle bodies 1A and 1B are formed as throttle holes 36*a* and 44*a*, respectively, the throttle holes 36*a* on the first throttle body 1A side where the bypass control valve 10 has a smaller diameter, and the throttle holes 44*a* on the second throttle body 1B side where the bypass control valve 10 has a larger diameter. Therefore, the flow path resistances of all the plurality of bypass downstream paths $\mathbf{12}b_1$, $\mathbf{12}b_2$; $\mathbf{12}b_3$, $\mathbf{12}b_4$ can be made uniform, although the lengths of the bypass downstream paths $\mathbf{12}b_1$, $\mathbf{12}b_2$; $\mathbf{12}b_3$, $\mathbf{12}b_4$ from the bypass control valve 10 to each of the throttle bodies 1A and 1B are smaller on the first throttle body 1A side and longer on the second throttle body 1B side. Consequently, the amount of first idling air supplied to the plurality of cylinders of the engine through the plurality of bypass downstream path is $\mathbf{12}b_1$, $\mathbf{12}b_2$; $\mathbf{12}b_3$, $\mathbf{12}b_4$ can be equalized.

Even in such a first idling state, certain flows of air supplied to the engine exist in the idling air paths $\mathbf{37}_1$, $\mathbf{37}_2$; $\mathbf{37}_3$, $\mathbf{37}_4$.

As the engine temperature rises with the progress of the warm-up operation, the electrically operated actuator 25 moves the valve body 26 downward to reduce the opening degrees of the measuring holes $\mathbf{19}_1$, $\mathbf{19}_2$; $\mathbf{19}_3$, $\mathbf{19}_4$ corresponding to the increase in engine temperature. The amount of first idling air supplied to the engine through the bypasses $12_1$, $12_2$; $12_3$, $12_4$ is thereby reduced to lower the engine rotational speed. When the temperature of the engine becomes equal to a predetermined high temperature, the electrically operated actuator 25 moves the valve body 26 into the completely closed state to completely close the bypasses $12_1$, $12_2$; $12_3$, $12_4$. Therefore, in the state where the throttle valves $51_1$, $5_2$; $5_3$, $5_4$ in the intake paths $2_1$, $2_2$; $2_3$, $2_4$ are closed, only the least amount of air are supplied to the engine through the idling air supply paths $37_1$, $37_2$; $37_3$, $37_4$, thus controlling the engine at the ordinary idling rotational speed. At this time, the amount of idling air flowing through the idling air supply paths $37_1$, $37_2$; $37_3$, $37_4$ can be individually regulated by turning the idling regulation screws $38_1$, $38_2$; $38_3$, $38_4$.

The bypass control valve 10 provided in the first throttle body 1A is constituted by the valve body 26 for opening/closing the pairs of bypasses $12_1$, $12_2$; $12_3$, $12_4$, and the electrically operated actuator 25 provided above the valve body 26 and operated for opening/closing the valve body 26. This simple arrangement ensures that even in a case where water droplets are generated in the bypasses $12_1$ and $12_2$ on the first throttle body 1A side near the bypass control valve 10 in particular or even in a case where fuel enters the $12_1$ and $12_2$ due to an engine blowback phenomenon, the fuel or water droplets can be prevented from flowing into the electrically operated actuator 25. Therefore no expensive sealing means is required for the electrically operated actuator 25, and only an inexpensive sealing suffices.

The bypass upstream side path 12*a* on the upstream side of the valve 26, i.e., the air inlet chamber 8 and the guide path 9 are placed below the valve body 26, and the idling air paths $37_1$ and $37_2$ extend from a lower portion of the air inlet chamber 8 to the intake paths $2_1$ and $2_2$ in the first throttle body 1A. Therefore, fuel or water droplets generated in the bypasses $12_1$ and $12_2$ or entering the bypasses $12_1$ and $12_2$ flows down to the bypass upstream path 12*a*, and the fuel or water droplets are discharged to the intake paths $2_1$ and $2_2$ by being carried on the air flows which are flowing from the idling air paths $37_1$ and $37_2$ to the downstream sides of the intake paths $2_1$ and $2_2$ and which are always formed in the bypass upstream path 12*a* irrespective of the opening/closing state of the valve body 26. Thus, staying of the fuel or water droplets in the bypasses $12_1$ and $12_2$ is prevented to ensure that the amount of first idling air is appropriately regulated by the bypass valve 10.

The air inlet chamber 8 and the guide path 9 constituting the bypass upstream path 12*a* form a single path common to the bypasses $12_3$ and $12_4$ on the second throttle body 1B side as well as to the bypasses $12_1$ and $12_2$ on the first throttle body 1A side. This arrangement contributes to simplification of the structure of the bypass control valve 10 as well as to simplification of the bypasses $12_1$, $12_2$; $12_3$, $12_4$. Also, the communication pipes $49_1$ and $49_2$ are provided only by piping between the bypass control valve 10 and the second throttle body 1B not having the valve 10, thus simplifying the pipe arrangement.

The bypass downstream paths $12b_1$ and $12b_2$ provided downstream of the bypass control valve 10 near the bypass control valve 10 on the first throttle body 1A side are constituted by the first labyrinth elements 34 and the second labyrinth elements 35 in a labyrinth shape, thereby attenuating gas blowback from the intake paths $2_1$ and $2_2$ and preventing fuel and other unnecessary substances from entering the bypass control valve 10.

The first throttle body 1A and the control block 15 in which the bypass control valve 10 is mounted are constructed as separate bodies joinable to and separable from each other, and correspondingly the plurality of bypasses $12_1$ and $12_2$ are also formed separately from each other, thus facilitating the formation of the bypasses $12_1$, $12_2$; $12_3$, $12_4$. Further, since the control block 15 and the bypass control valve 10 can be assembled into one unit separately from the first throttle body 1A, the assemblability of the components becomes excellent. Furthermore, since the control block 15 can be separate from the first throttle body 1A, the ease of maintenance of the bypass control valve 10 and other components becomes excellent.

The present invention is not limited to the above-described embodiment thereof. Various changes in design of the present invention can be made without departing from the subject matter of the present invention. For example, the first throttle body 1A having the bypass control valve 10 may be singly used as an intake system for a two-cylinder engine. The present invention is also applicable to a horizontal throttle body in which intake paths are generally horizontal. Also in this case, the vertical positional relationship among the electrically operated actuator 25, the valve body 26 and the bypass upstream path 12*a* is same as that in the above-described embodiment.

What is claimed is:

1. A multicylinder engine intake system comprising:

a plurality of intake paths communicating with intake ports of a multicylinder engine;

a plurality of throttle valves for opening and closing the intake paths;

a plurality of bypasses having upstream ends opened to atmosphere or the intake paths on upstream sides of the throttle valves, and having downstream ends opened to the intake paths on downstream sides of the throttle valves; and a common bypass control valve which opens and closes the bypasses, wherein the bypass control valve is constituted by a valve body for opening the plurality of bypasses, and an electrically operated actuator provided above the valve body and operated for opening and closing the valve body; a portion of a bypass upstream path in the bypasses on upstream side of the valve body is placed below the valve body; and idling air paths branch off from the portion of the bypass upstream path to reach the corresponding intake paths.

2. The multicylinder engine intake system according to claim 1, wherein the bypass upstream path is formed as a single path common to the plurality of bypasses.

3. The multicylinder engine intake system according to claim 2, wherein a plurality of bypass downstream paths, on downstream side of the bypass control valve, of the plurality of bypasses are formed into a labyrinth shape.

4. The multicylinder engine intake system according to claim 1, wherein a plurality of bypass downstream paths, on downstream side of the bypass control valve, of the plurality of bypasses are formed into a labyrinth shape.

* * * * *